US005535806A

United States Patent [19]

Kold et al.

[11] Patent Number: 5,535,806

[45] Date of Patent: Jul. 16, 1996

[54] ROLLER BLIND, PARTICULARLY FOR USE AS BLACKOUT SHADE

[75] Inventors: Ove Kold; Torben Mikkelsen, both of Borris, Denmark

[73] Assignee: V. Kann Rasmussen Industri A/S, Søborg, Denmark

[21] Appl. No.: 290,958

[22] PCT Filed: Mar. 10, 1993

[86] PCT No.: PCT/DK93/00090

§ 371 Date: Aug. 24, 1994

§ 102(e) Date: Aug. 24, 1994

[87] PCT Pub. No.: WO93/18270

PCT Pub. Date: Sep. 16, 1993

[30] Foreign Application Priority Data

Mar. 11, 1992 [DK] Denmark ..... 0322/92

[51] Int. Cl.[6] ..... E06B 9/56

[52] U.S. Cl. ..... 160/273.1; 160/279

[58] Field of Search ..... 160/265, 279, 160/322, 84.06, 271, 273.1, 23.1, 133

[56] References Cited

U.S. PATENT DOCUMENTS

| | | | |
|---|---|---|---|
| 560,133 | 5/1896 | Emery | 160/279 |
| 564,682 | 7/1896 | Burrowes | 160/279 |
| 577,842 | 3/1897 | Davis | 160/279 |
| 785,806 | 3/1905 | Hopkins . | |
| 794,937 | 7/1905 | Hopkins . | |
| 1,815,551 | 7/1931 | Dunn | 160/279 X |
| 2,243,771 | 5/1941 | Nye | 160/265 |
| 2,780,283 | 2/1957 | Wasserman | 160/265 X |
| 4,473,101 | 9/1984 | Langeler | 160/279 X |
| 4,574,864 | 3/1986 | Tse | 160/279 X |
| 4,762,160 | 8/1988 | Bechtold et al. | 160/265 X |
| 5,088,543 | 2/1992 | Bilbrey | 160/265 X |
| 5,280,818 | 1/1994 | Ubelhart | 160/265 |

FOREIGN PATENT DOCUMENTS

| | | |
|---|---|---|
| 2615240 | 5/1987 | France . |
| 2642466 | 1/1990 | France . |
| 2663675 | 6/1990 | France . |
| 84074884 | 3/1984 | Germany . |

*Primary Examiner*—David M. Purol
*Attorney, Agent, or Firm*—Lane, Aitken & McCann

[57] ABSTRACT

For a roller blind, particularly for use as a blackout shade, and with a spring-biased roller bar and a blind rolled on the roller bar and having along its lateral edges guide members guided in tracks in guide rails disposed at both sides of the window opening, and a bottom bar, a brake device is provided for retaining the bottom bar in an arbitrary position against the effect of the bias-force by a cord arrangement with a cord which at the bottom of one guide rail is passed through the guide rail, the bottom bar and the other guide rail to a fixture at the top thereof. A friction mechanism acting on the cord two pins is mounted in the bottom bar over which the cord is passed in S-shape. To ensure parallel guidance of the bottom bar in relation to the roller bar the cord arrangement may include two cords mounted in mirror-inversion.

12 Claims, 2 Drawing Sheets

ROLLER BLIND, PARTICULARLY FOR USE AS BLACKOUT SHADE

BACKGROUND OF THE INVENTION

The invention relates to a roller blind, particularly for use as a blackout shade, comprising a spring-biassed roller bar designed to be mounted at the top of a window opening and a blind rolled on the roller bar and having along its lateral edges guide members guided in tracks provided in guide rails disposed at both sides of the window opening, a bottom bar for the blind being likewise provided, at both ends, with guide means engaging guideways in said guide rails, and being further controlled by means of a cord arrangement with a cord which from a fixture means at the bottom of one guide rail is passed through the part of said guide rail positioned beneath the bottom bar, the bottom bar itself, and the part of the other guide rail positioned above the bottom bar, to a fixture means at the top of the other guide rail.

In roller blinds to be mounted in connection with skylights in inclined roofs use is made of a spring-biassed roller bar ensuring that the blind is kept tight in all positions between the completely raised position and the maximum drawn bottom position.

In order to enable the bottom bar to be arrested in its bottom position and in a number of intermediate positions it is known to mount side rails along the longitudinal sides of the window frame, the side rails being provided with downwards facing recesses for engagement with pins or the like at the ends of the bottom bar. This makes it possible to retain the bottom bar in a limited number of intermediate positions.

Such comparatively simple side rails are, however, not usable in connection with blinds for blackout shades of the above mentioned type, in which the side guide rails must be designed so as to ensure light-proofness at the edges of the window. At the top and at the bottom of the window opening light-proofness is obtained by providing the roller bar, which is most frequently enclosed in a cassette, as well as the bottom bar with appropriate sealing strips.

In U.S. Pat. No. 785,806 a roller blind of the above mentioned type is disclosed in which the movement of the bottom bar is controlled by a double cord arrangement ensuring parallel guidance of the bottom bar in relation to the roller bar, thereby preventing the bottom bar from getting jammed due to careless operation.

SUMMARY OF THE INVENTION

In comparison with the prior art it is the object of the invention to provide a design of a roller blind, particularly for blackout shading, which makes it possible to retain the bottom bar against the spring bias force exerted on the roller bar in arbitrary positions between the top position and the bottom position.

with a view to this, a roller blind of the above mentioned type is characterized in that a brake device for retaining the bottom bar in an arbitrary position against the effect of said spring bias includes a friction member mounted in the bottom bar and acting on the cord, a device for tightening the cord being provided in association with one of said fixture means.

With such a comparatively simple frictional brake device it has turned out to be possible to obtain a braking force which in any position of the bottom roller is sufficient to equalize the spring bias force. As it appears from the following the frictional brake device may be made to cooperate with the cord tightening member and the spring bias of the roller bar in such a manner that the brake force does not reduce the operational comfort.

In a preferred embodiment of the invention the means for parallel guidance include a supplementary cord arrangement passed through the guide rails and the bottom part, in reverse mounting in relation to said cord.

BRIEF DESCRIPTION OF THE DRAWINGS

The invention will now be explained in detail with reference to the schematical drawings, in which.

DETAILED DESCRIPTION OF THE PREFERRED EMBODIMENT

Figure 1:
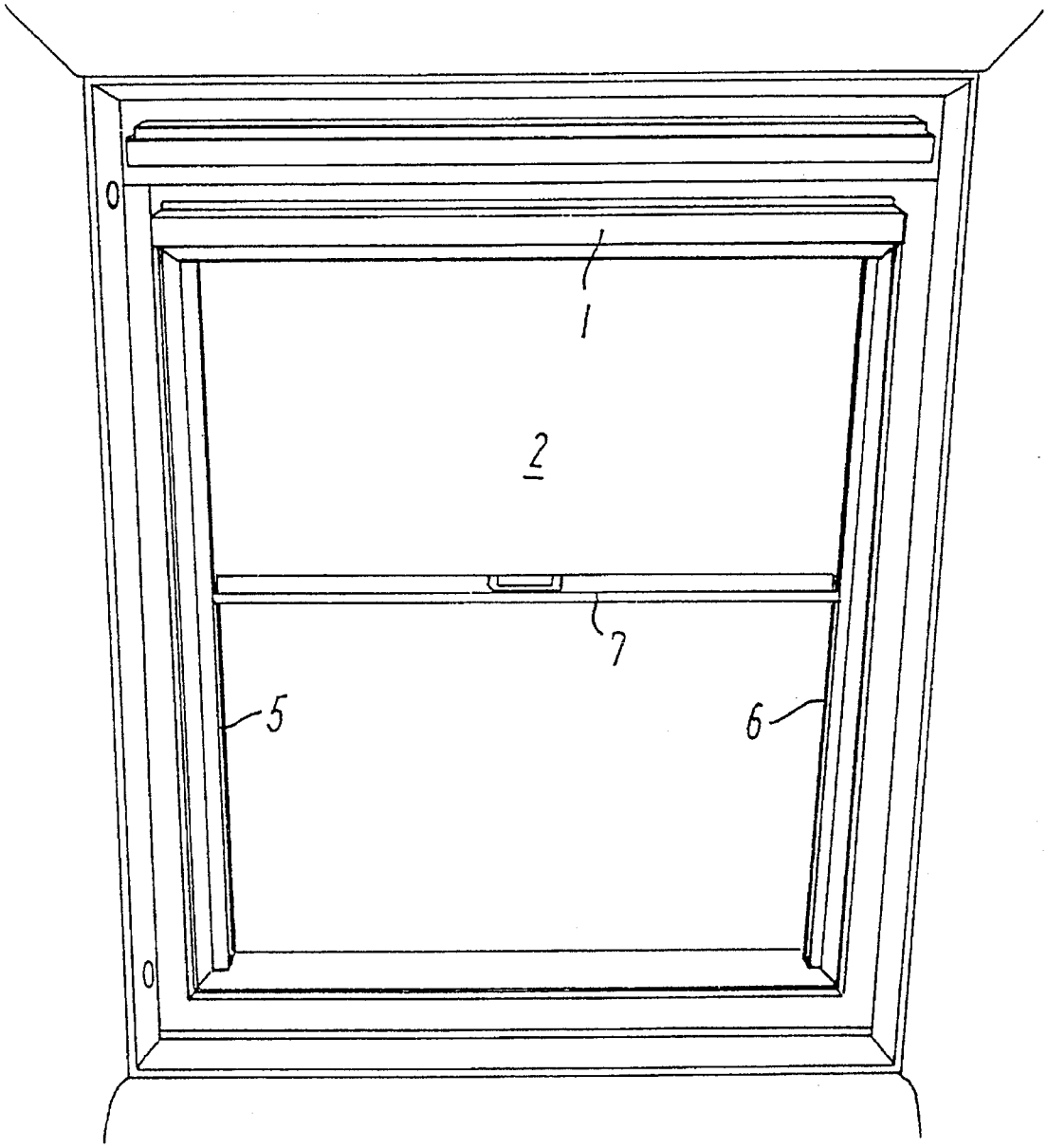
FIG. 1 shows a skylight equipped with a roller blind as a blackout shade, provided according to an embodiment of the invention.
Figure 2:
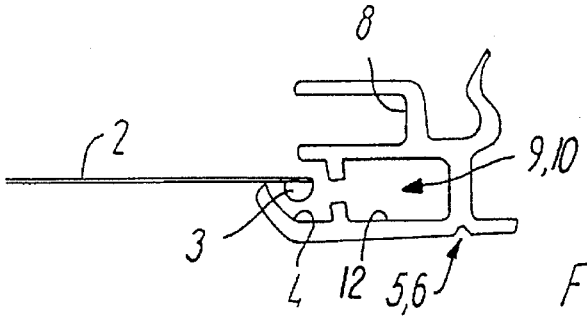
FIG. 2 is a cross-section of a side guide rail.

In the roller blind for a blackout shade illustrated in FIG. 1 a spring-biassed roller bar, not shown in detail, is enclosed in a cassette 1 mounted atop the window opening in such a manner that it fits light-proof to the window main frame. A blind 2 of light-proof material is rolled on the roller bar. Guide members, e.g. in the form of semispherical buttons 3 which, as illustrated in FIG. 2, are guided in tracks 4 provided in guide rails 5 and 6 disposed at either side of the window opening are in a manner known per se spaced apart along both of the lateral edges of the blind 2, at distances which may for instance vary from 3 to 10 cm.

At the bottom the blind is fastened in a bottom bar 7 having guide means at the ends, likewise engaging guideways 8 in the guide rails 5 and 6.

Since due to the spring bias acting on the roller bar the blind is constantly biassed in the raising direction in order to be kept tightened, an arresting mechanism is needed to retain the drawn blind 2 in the bottom position of the roller bar 7 as well as in intermediate positions.

Figure 3:
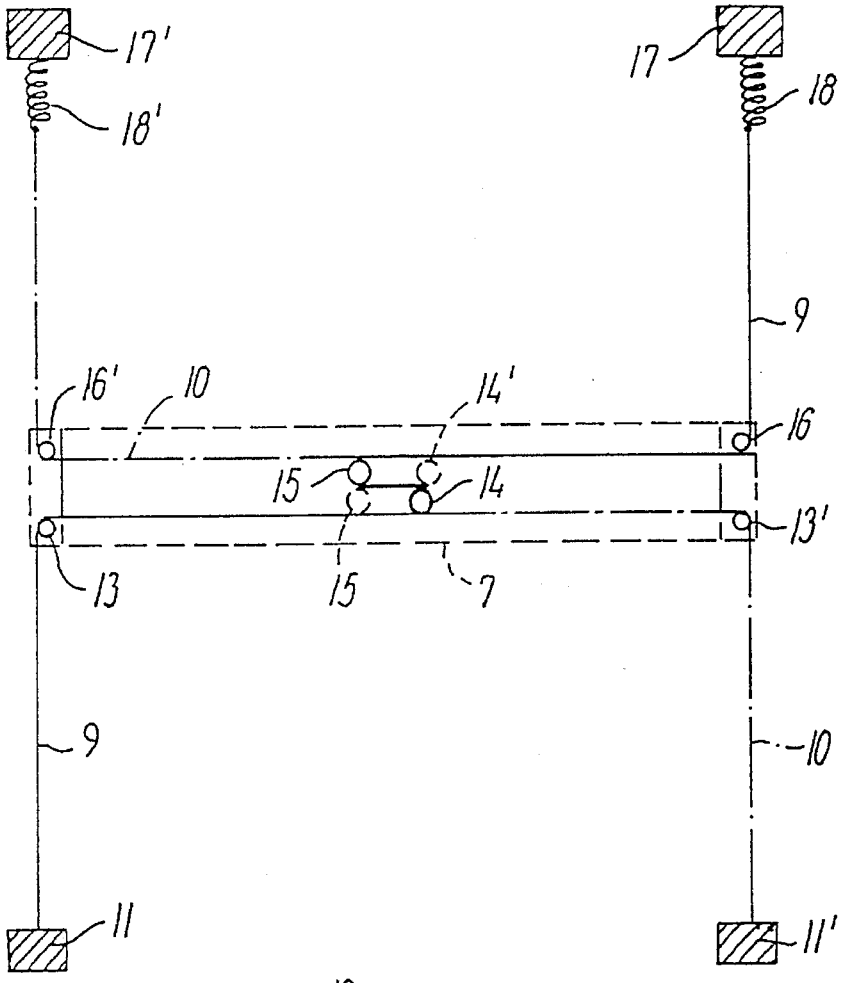
FIG. 3 is a schematical diagram of a brake device and a device for parallel guidance with two mirror-inverted cord arrangements.

In order to obtain a stepless variable arresting in arbitrary positions of the bottom bar 7, said arresting mechanism includes a brake device of which an embodiment is illustrated in FIG. 3.

In this case the brake device comprises a mirror-inverted arrangement of two cords 9 and 10, of which the cord 9 shown in solid lines in the figure is passed from a fixture means 11 at the bottom of the left guide rail 5 up through a track 12 in this guide rail, shown in FIG. 2, and over a roller or pin 13 through the bottom bar 7 in which a friction member acting on the cord in the illustrated embodiment includes two pins 14 and 15 around which the cord is passed in S-shape and from there further on to the opposite end of the bottom bar 7, from where it is passed over a roller or pin 16 through the part of the guideway 12 positioned above the bottom bar 7 of the right slotted guide 6 to a fixture means 17 at the top of said slotted guide.

The fixture means 11 and 17 may appropriately be provided in retaining means, e.g. a plastic plug, that may be inserted at the bottom of the guide rail 5 and a clip-like plug that may be mounted at the top of the guide rail 6. With the view of tightening the cord 9, the upper end thereof is connected with a tension spring 18 mounted in the fixture means 17.

As mentioned above, the cord 10 is mirror-inverted in relation to the cord 9, and the fixture and cord guiding means for this cord have the same reference numerals as the corresponding members for the cord 9, but further marked with an apostrophe.

This double cord arrangement provides for obtaining both an effective braking capable of retaining the bottom bar 7 arrested in an arbitrary position between the top and the bottom, and an accurate parallel guidance of the bottom bar 7 in relation to the roller bar mounted in the cassette 1.

The braking effect is caused by the S-shaped twisting of the cords 9 and 10, respectively, around the pins 14, 15 and 14', 15', respectively, the friction between the cords and said pins and the tension exerted by the springs 18 and 18'.

As regards the equilibrium as to force of the system the following formula applies to both of the cords 9 and 10

$$S_1=S_2\cdot e^{\mu\cdot\alpha}$$

wherein $S_1$ and $S_2$ are the cord tension before and after the cord is passing the pins 14, 15 and 14', 15', respectively, $\mu$ is the friction of each cord against the actual pin, and $\alpha$ is the total of the angle changes of the two entwinements of each cord, in this case 360°.

The illustrated S-shaped cord path represents only an embodiment, because reversal of direction may be effected by means of a single pin around which the cord may be passed in an entwinement of 360°. This, however, involves the inconvenience that the cord when running off the pin will slide against itself, thereby being exposed to more wear than in the illustrated example with two entwinements of 180°.

It is apparent that the braking force may be controlled by choosing a larger number of pins, other angle changes of the cord entwinement round the individual pins and stronger or weaker springs. By these means the braking force is easily dimensioned so that the bottom bar may be safely retained in arbitrary positions. Experiments have shown that the embodiment illustrated in FIG. 3 allows the cords to stand far more than 10,000 raisings and drawings of the blind with no substantial wear and deterioration of the braking effect.

At the same time the cooperation of the frictional brake device with the springs 18, 18' and the spring bias in the roller bar, not shown, entail that the braking force does not hamper the operation of the blind. At a pull downwards at the bottom bar 7 the cord tension between the bottom bar 7 and the springs 18, 18' suddenly increases due to the brake device, whereas the cords between the bottom bar 7 and the fixture means 11, 11' slacken, thereby causing the braking effect to decline so that the blind may easily be drawn. When the blind is raised the full braking force from the brake device must incidentally be overcome but the raising movement is supported by the spring bias of the roller bar.

Figure 4:
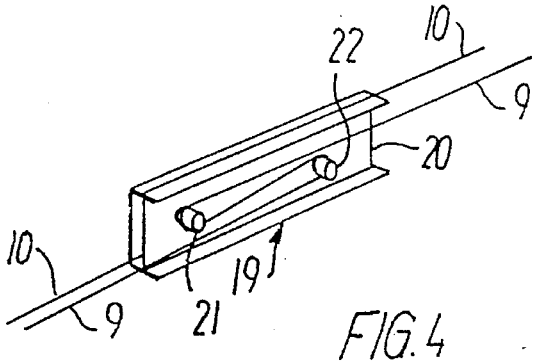
FIGS. 4 and 5 illustrate a holder for friction members for the two cord arrangements, designed to be mounted in the bottom bar of the roller blind.
Figure 5:
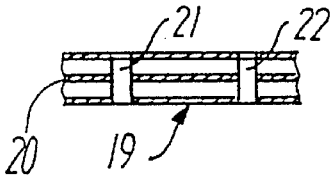

The cord inverting arrangement in the bottom bar may advantageously be provided in that the pins 14, 15 and 14', 15', respectively are mounted in a common holder 19 design for being fixed in the bottom bar 7, as illustrated in FIGS. 4 and 5. In this holder the cord paths for the cords 9 and 10 are separated by a partition wall 20 and in contradiction to the schematical illustration in FIG. 3 the reversal of both cord paths is provided by means of two common pins 21 and 22 extending through the holder 19 on both sides of the partition wall 20.

The invention is not restricted to the illustrated design of the brake device with an arrangement of reversal for the cords, the braking force being achieved with other designs of the friction members acting on the cords.

If the parallel guidance of the bottom bar 7 is ensured in another way, a double cord arrangement is neither necessary, even though this must be supposed to allow the simplest design.

The applicability of the invention is not restricted to blinds for blackout shades but may include any form of roller blind with a constantly spring-biassed blind for which it is desired to have the possibility of arresting in arbitrary positions.

We claim:

1. A roller blind, particularly for use as a blackout shade, comprising a spring-biased roller bar for mounting at the top of a window opening and a blind rolled on the roller bar, said blind having lateral edges along which guide members are provided, guide rails disposed at both sides of the window opening being provided with tracks for guiding said guide members, said blind further comprising a bottom bar having two ends each having further guide means, guideways being provided in said guide rails for engaging said further guide means, a cord arrangement for controlling the raising and lowering of said blind, said cord arrangement comprising a cord having one end connected to a fixture means arranged at a bottom of one of said guide rails and passing therefrom through a part of said guide rail positioned below said bottom bar, through the bottom bar, and through a part of the other guide rail positioned above said bottom bar to an opposite end, said opposite end being connected to a fixture means arranged at a top of the other guide rail, said blind further comprising a brake device firmly mounted in said bottom bar and including a friction member acting as a reversing member for the cord to provide a total change of its direction of substantially 360° to permit the bottom bar to be retained in any arbitrary position against the effect of the spring bias, said cord arrangement further comprising a device for tightening the cord being provided at one of said fixture means.

2. A roller blind as claimed in claim 1, wherein said friction member comprises two pins disposed in said bottom bar, the cord being passed over the pins in an S-shape.

3. A roller blind as claimed in claim 2, wherein said two pins are provided in a common holder for mounting in the bottom bar.

4. A roller blind as claimed in claim 1, wherein said fixture means for the cord comprise retaining means to be inserted in respective ends of the two guide rails.

5. A roller blind as claimed in claim 4, wherein said cord tightening member consists of a tension spring mounted in one of said fixture means and connected with one of the ends of the cord.

6. A roller blind as claimed in claim 3, in which, in order to ensure parallel guidance of the bottom bar in relation to the roller bar, the cord arrangement includes two cords passed through the guide rails and the bottom bar in reverse mounting relative to one another, said holder includes two reversing pins common to both cords and the holder is provided with a partition wall for separating the two cord paths.

7. A roller blind particularly for use as a blackout shade, comprising a spring-biased roller bar for mounting at the top of a window opening and a blind rolled on the roller bar, said blind having lateral edges and guide members along the lateral edges, guide rails disposed at both sides of the window opening, the guide rails having tracks for guiding said guide members, said blind further comprising a bottom bar having two ends each having further guide means, said guide rails having guideways for engaging said further guide means, a cord arrangement for controlling the raising and lowering of said blind, said cord arrangement comprising a first cord having one end connected to a fixture arranged at a bottom of a first one of said guide rails and passing therefrom through a part of said guide rail positioned below said bottom bar, through the bottom bar and through a part of the other guide rail positioned above said bottom bar to an opposite end of the first cord, said opposite end being connected to a fixture arranged at a top of the other guide rail, said blind further comprising a brake device mounted in said bottom bar and including a friction member fixed with respect to the bottom bar and having a perimeter in frictional engagement with the first cord, the cord being in engagement with substantially 360° of the perimeter of the friction reversing member to permit the bottom bar to be retained in any arbitrary position against the effect of the spring bias, said cord arrangement further comprising means for tensioning the first cord, said tensioning means being positioned at one of said fixtures.

8. A roller blind as claimed in claim 7, wherein said friction member comprises two pins disposed in said bottom bar, each said pin having a perimeter, the first cord being passed around the perimeters of the pins in an S-shape.

9. A roller blind as claimed in claim 8, wherein said two pins are positioned in a common holder for mounting in the bottom bar.

10. A roller blind as claimed in claim 7, wherein said fixtures for the cord are positioned in respective ends of the two guide rails.

11. A roller blind as claimed in claim 10, wherein said means for tensioning the cord comprises a tension spring connected to one of said fixtures and one of the ends of the cord.

12. A roller blind as claimed in claim 9, in which, in order to ensure parallel guidance of the bottom bar in relation to the roller bar, the cord arrangement further includes a second cord having one end connected to a fixture arranged at a bottom of said other guide rail and passing therefrom through a part of said other guide rail positioned below said bottom bar, through the bottom bar, and through a part of the first guide rail positioned above said bottom bar to an opposite end of the second cord, said opposite end of said second cord being connected to a fixture arranged at a top of the first guide rail, the second cord being in engagement with substantially 360° of the perimeter of the friction member, and means for tensioning the second cord.

* * * * *